US008793943B2

(12) United States Patent
Daniels

(10) Patent No.: US 8,793,943 B2
(45) Date of Patent: Aug. 5, 2014

(54) VENTILATION SYSTEM FOR ROOF

(76) Inventor: Gregory S. Daniels, Santa Rosa, CA (US)

( * ) Notice: Subject to any disclaimer, the term of this patent is extended or adjusted under 35 U.S.C. 154(b) by 0 days.

(21) Appl. No.: 13/638,914

(22) PCT Filed: Mar. 25, 2011

(86) PCT No.: PCT/US2011/030027

§ 371 (c)(1),
(2), (4) Date: Oct. 1, 2012

(87) PCT Pub. No.: WO2011/126773

PCT Pub. Date: Oct. 13, 2011

(65) Prior Publication Data

US 2013/0019548 A1 Jan. 24, 2013

Related U.S. Application Data

(60) Provisional application No. 61/321,474, filed on Apr. 6, 2010.

(51) Int. Cl.

| | |
|---|---|
| ***E04B 7/00*** | (2006.01) |
| ***E04H 12/28*** | (2006.01) |
| ***E04D 1/26*** | (2006.01) |
| ***F24F 7/02*** | (2006.01) |
| *E04D 1/30* | (2006.01) |

(52) U.S. Cl.

CPC ..... *F24F 7/02* (2013.01); *E04D 2001/309* (2013.01); *E04D 1/30* (2013.01); *E04D 1/26* (2013.01)

USPC ..... 52/198

(58) Field of Classification Search

USPC ..... 52/198

See application file for complete search history.

(56) References Cited

U.S. PATENT DOCUMENTS

| | | | |
|---|---|---|---|
| 6,050,039 | A | 4/2000 | O'Hagin |
| 6,061,978 | A | 5/2000 | Dinwoodie et al. |
| 6,286,273 | B1 | 9/2001 | Villela et al. |
| 6,390,914 | B1 | 5/2002 | O'Hagin et al. |
| 6,447,390 | B1 | 9/2002 | O'Hagin |
| 6,537,147 | B2 | 3/2003 | Smith |

(Continued)

OTHER PUBLICATIONS

International Search Report and Written Opinion dated Nov. 5, 2012 in Application No. PCT/US2011/030027, filed Mar. 25, 2011.

(Continued)

*Primary Examiner* — Mark Wendell
(74) *Attorney, Agent, or Firm* — Knobbe Martens Olson & Bear LLP

(57) ABSTRACT

A roof vent and a roof structure are described. A roof vent can include a baffle with a cross-section where a first portion extends upward from a bottom plate and a second portion extends from the first portion to define a space between the bottom plate and the second portion. A roof structure may or may not have a roof deck, and comprises a plurality of roof cover elements with a radiant barrier layer underneath the top surfaces of at least some of the roof cover elements. In another embodiment, a roof structure may comprise more sheathing layer vent members than roof cover layer vent members. In yet another embodiment, a roof structure may comprise a layer of roof tiles with at least one vent member, the vent member comprising lateral end portions of a base member with a non-planar profile to engage a similar profile of an adjacent roof cover element.

10 Claims, 16 Drawing Sheets

(56) References Cited

U.S. PATENT DOCUMENTS

| | | | | |
|---|---|---|---|---|
| D512,774 | S | 12/2005 | O'Hagin et al. | |
| 7,250,000 | B2 | 7/2007 | Daniels, II | |
| D549,316 | S | 8/2007 | O'Hagin et al. | |
| D588,255 | S | 3/2009 | Daniels | |
| D588,256 | S | 3/2009 | Daniels | |
| D589,134 | S | 3/2009 | O'Hagin et al. | |
| 7,618,310 | B2 | 11/2009 | Daniels | |
| D610,245 | S | 2/2010 | Daniels | |
| 2007/0072541 | A1* | 3/2007 | Daniels et al. | 454/365 |
| 2007/0173191 | A1* | 7/2007 | Daniels et al. | 454/250 |
| 2007/0207725 | A1* | 9/2007 | O'Hagin | 454/365 |

OTHER PUBLICATIONS

DECRA® Products Homepage, http://www.decra.com/products.htm, Printed Aug. 4, 2008, 2 pages.

DECRA® Mediterranean Tile, http://www.decra.com/tile.htm, Printed Aug. 4, 2008, 1 page.

DECRA® Ageless Beauty Brochure, DECRA Roofing Systems, Inc., 2007, 8 pages.

DECRA® All Profile Brochure, DECRA Roofing Systems, Inc., 2004, 2 pages.

DECRA® Tile, Shingle, Shingle Plus Installation Guide, DECRA Roofing Systems, Inc., Printed Aug. 4, 2008, 19 pages.

DECRA® Villa Tile, http://www.decra.com/villatile.htm, Printed Aug. 4, 2008, 1 page.

DECRA® Villa Tile Brochure, DECRA Roofing Systems, Inc., Printed Aug. 4, 2008, 2 pages.

DECRA® Shake, http://www.decra.com/shake.htm, Printed Aug. 4, 2008, 1 page.

Functional Components of a DECRA Panel, DECRA Roofing Systems, Inc., 2005, 1 page.

Office Action for Australian Application No. 2011238673, filed Apr. 6, 2010, dated Apr. 10, 2013.

* cited by examiner

VENTILATION SYSTEM FOR ROOF

REFERENCE TO RELATED APPLICATIONS

The present application is a U.S. National phase of international application number PCT/US2011/030027, filed Mar. 25, 2011, which is a Non-Provisional of U.S. application Ser. No. 61/321,474, filed Apr. 6, 2010. Each of the priority applications is hereby incorporated by reference in its entirety.

BACKGROUND OF THE INVENTION

1. Field of the Invention

This application relates generally to building ventilation and specifically to roof ventilation.

2. Description of the Related Art

Energy efficiency is a serious consideration in new home design. New homes require ways to minimize energy requirements to maintain comfortable living spaces. One of the most common energy losses in a home is due to heat transfer through the attic. In warm climates, heat builds up in the attic from solar energy incident on the roof. In colder climates, moisture builds up in the attic, robbing the insulation of much of its R value. Early efforts at minimizing the effects of heat and/or moisture build-up focused on insulation between the living space and the attic. Gable vents and dormer type passive ventilation systems have been incorporated to ventilate the attic. U.S. Pat. No. 6,050,039 to O'Hagin describes one such camouflaged passive ventilation system.

Ventilation systems have been provided to enhance the insulation of a roof. Such ventilation systems remove heat and/or moisture build-up in the attic, thus minimizing energy losses due to heat transfer through the attic. Typical roof ventilation systems have included a combination of roof vents and roof cover materials, such as tiles. The roof vents conduct airflow between the regions above and below the roof.

Recently, it has been shown that providing an airspace or air layer below the roof cover materials (e.g., tiles, shingles, etc.) but above the sheathing (e.g., a plywood or metal roof deck) improves the energy efficiency of the building, even if the air layer is not ventilated. If the airspace is ventilated (i.e., in fluid communication with the attic and the building exterior), energy efficiency is further improved.

Additionally, a roof can include a radiant barrier to enhance the insulation. The radiant barrier layer enhances the insulation by reflecting radiant heat away from the roof. Traditionally, buildings with radiant barrier layers have been used as a means to simultaneously reflect radiant heat away from the roof and trap heat within the building. However, buildings with radiant barriers still have heat or moisture build-up in the attic. What is needed is an improved ventilation system which minimally detrimentally affects the appearance of a building design and is applicable to various types of roofs, while offering low installation costs relative to other ventilation systems.

SUMMARY OF THE INVENTION

In accordance with one embodiment, a roof vent is provided. The roof vent includes a roof cover layer vent member comprising a bottom plate and a top plate having downslope edges spaced apart to define a gap between the plates. The bottom plate comprises an opening to allow airflow between the gap and a space below the bottom plate. The bottom plate and the top plate are connected to each other upslope of the opening. The roof vent also comprises a baffle connected to the bottom plate and positioned between the bottom plate and the top plate. At least a portion of the baffle is positioned between the downslope edge and the opening and comprises a cross-section having a first portion extending upward from the bottom plate and a second portion extending from the first portion in a downslope direction away from the opening, to define a space between the bottom plate and the second portion.

In accordance with another embodiment, a roof structure is provided. The roof structure comprises a roof deck and a layer of roof cover elements spaced above the roof deck to define an air layer between the roof deck and the layer of roof cover elements. At least some of the roof cover elements have a radiant barrier, wherein the radiant barriers are underneath the top surfaces of said roof cover elements.

In accordance with yet another embodiment, a plurality of roof cover elements is provided. At least some of the roof cover elements comprise a body having an engagement structure for engaging the body or bodies of one or more other ones of said roof cover elements in accordance with a repeating engagement pattern. The bodies are configured to collectively cover at least a portion of a roof when so engaged with one another. At least some of the roof cover elements further comprise a radiant barrier on or within the body, wherein the radiant barrier is underneath the top surfaces of at least some of the roof cover elements.

In accordance with still another embodiment, a roof structure is provided. The roof structure comprises a plurality of rafters, a plurality of battens over the rafters without a roof deck between the battens and the rafters, a plurality of roof cover elements supported by the battens, and a radiant barrier underneath the top surfaces of at least some of the roof cover elements.

In accordance with another embodiment, a roof structure is provided. The roof structure comprises a roof deck having a plurality of openings, a plurality of primary vent members installed on the roof deck. Each primary vent member has an aperture positioned in alignment with one of the openings in the roof deck so that the apertures permit airflow between regions above the roof deck and below the roof deck. The roof structure further comprises a roof cover layer spaced above the roof deck to define an air layer therebetween. The roof cover layer comprises a plurality of non-vent roof cover elements, and a plurality of secondary vent members, each having at least one opening to permit airflow from the air layer to a space above the roof cover layer. A total number of primary vent members in the roof structure is at least 1.5 times greater than a total number of secondary vent members in the roof structure.

In accordance with yet another embodiment, a roof structure is provided. The roof structure comprises a layer of roof tiles that form a repeating pattern when assembled on a roof, and at least one vent member that replaces and mimics an appearance of one or more of the roof tiles within said layer. The vent member comprises a cover member and a base member joined together and having downslope edges spaced apart. The base member has lateral end portions extending laterally beyond lateral edges of the cover member, and each of the lateral end portions of the base member has a non-planar profile conforming to and engaging a similar profile of an adjacent roof tile.

For purposes of summarizing the invention and the advantages achieved over the prior art, certain objects and advantages of the invention have been described above and as further described below. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE EMBODIMENTS

Figure 1A:
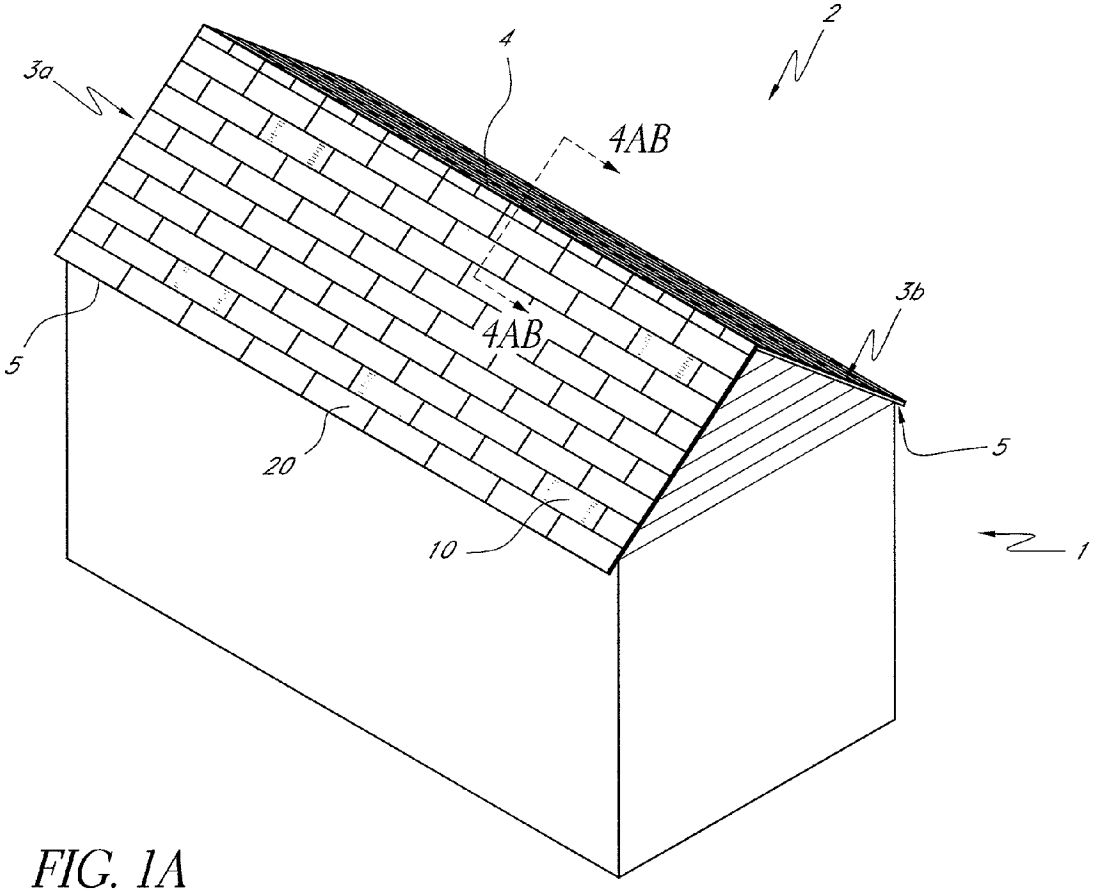
FIG. 1A is a schematic perspective view of a building having a roof and roof vents in accordance with one embodiment of the invention.

FIG. 1A shows a building 1 with a roof 2 comprising two fields 3*a* and 3*b* that are joined at their upper ends to define a ridge 4. Lower edges 5 of the fields are referred to as "eaves." The fields 3*a* and 3*b* typically comprise a sheathing or roof deck covered with a layer of roof cover elements 20 such as tiles (e.g., clay, metal, or concrete), shingles (e.g., wooden, clay, asphalt, or composition), or sheeting (e.g., metal). The sheathing is typically supported by rafters (not shown). Along with roof cover elements 20, the fields 3*a* and 3*b* may also comprise a radiant barrier layer (not shown) and vent members 10. The illustrated roof is suitable for having one or more vent members 10 according to one embodiment of the invention. Also, skilled artisans will appreciate that the vent members may be provided in a wide variety of different types of roofs, including those not having ridges or sloped fields. In FIG. 1A, a plurality of substantially aligned vent members 10 is positioned on the field 3*a* near the ridge 4, and a plurality of substantially aligned vent members 10 is positioned near the eave 5 of the roof 2. The vent members 10 are preferably provided in each field 3*a*, 3*b*. In another embodiment, the vent members 10 are positioned near each corner of the field 3*a*, 3*b*. In other embodiments, the vent members 10 may be positioned alternatively or additionally on different parts of the field 3*a*, 3*b*, depending on the ventilation needs.

Figure 1B:
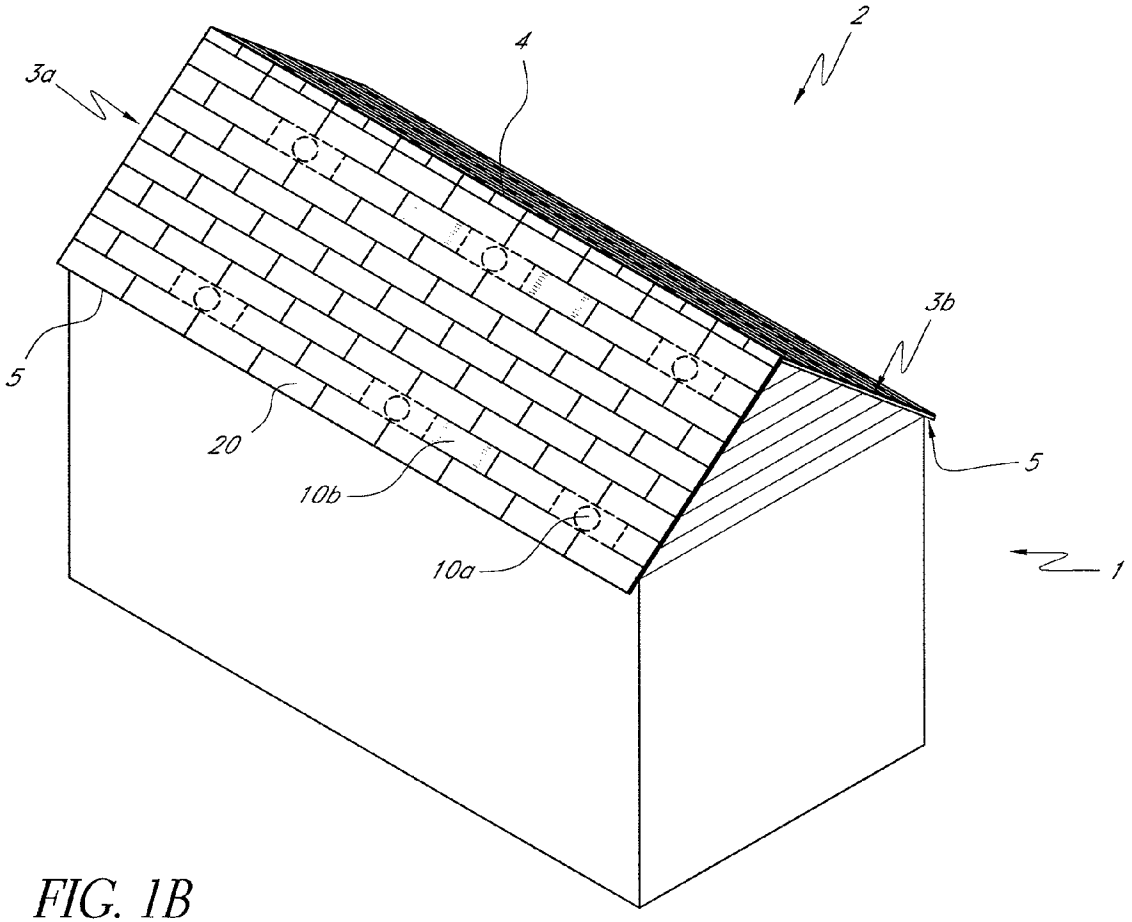
FIG. 1B is a schematic perspective view of a building having a roof, primary roof vents, and secondary roof vents in accordance with another embodiment of the invention.

In FIG. 1B, in another embodiment of a roof structure, the building 1 with the roof 2 comprises a layer of roof cover elements 20 that form the top layer (or "roof cover layer") of the roof 2, and a plurality of primary vent members. The layer of roof cover elements 20 may comprise a plurality of non-vent elements as well as a plurality of secondary vent members 10*b*. Embodiments of primary and secondary vent members will be described in further detail below. The primary vent members 10*a* are installed within the sheathing (or roof deck) and are covered by the layer of non-vent roof cover elements 20 and secondary vent members 10*b*. Hence, since the primary vent members 10*a* are not visible from above the roof 2, they are shown in broken lines in FIG. 1B. Each secondary vent member 10*b* preferably replaces one or more of the non-vent roof cover elements 20 in accordance with a repeating engagement pattern of the roof cover elements 20 for engaging one another (the replaced roof cover element 20 not being a secondary vent member 10*b*). The primary vent members 10*a* may alternatively be referred to as sheathing layer vent members or sub-flashings. The secondary vent members 10*b* may alternatively be referred to as roof cover layer vent members or roof cover vent tiles (in embodiments in which the vent members 10*b* replace roof tiles). The illustrated primary vent members 10*a* (e.g., sub-flashings) and secondary vent members 10*b* (e.g., vent tiles) are provided along the ridge 4 and the eave 5. In one embodiment, the roof's number of primary vent members 10*a* is greater than the number of secondary vent members 10*b*. For example, the number of primary vent members 10*a* may be greater than the number of secondary vent members 10*b*, preferably by a factor greater than or equal to x, where x can be 1.5, 1.75, 2, 2.5, 3, or 4. Each primary vent member 10*a* can be positioned underneath one of the non-vent roof cover elements 20 or one of the secondary vent members 10*b*.

Figure 2:
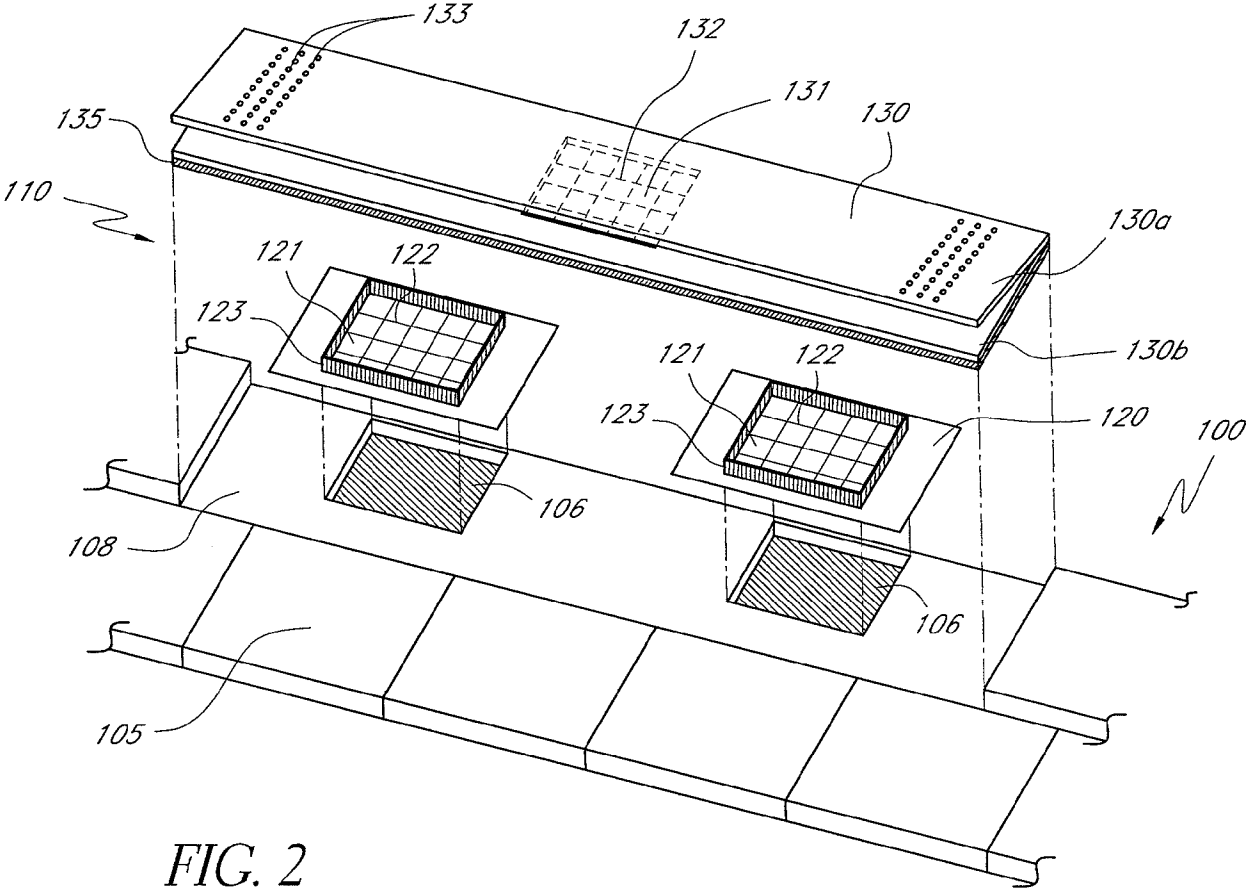
FIG. 2 is a schematic exploded perspective view of one embodiment of a roof structure having a roof vent.

FIG. 2 is a schematic exploded perspective view of one embodiment of a roof 100 having a roof vent 110. The roof 100 has a roof supporting structure (not shown), and a layer of roof cover elements 105. One of the roof cover elements may comprise roof vent 110. In this embodiment, the roof 100 includes a roof deck 108 (alternatively referred to as a "sheathing layer"), typically formed of plywood.

The roof supporting structure may include structural members, such as rafters. Rafters typically extend perpendicular to and between the ridge and the eave. The rafters may run in parallel to one another. In certain embodiments, the roof supporting structure may also include beams extending parallel to and between the ridge and the eave. Such beams may be referred to as "purlins." The roof supporting structure may be formed of wood and/or metal. A skilled artisan will appreciate that the configuration of the roof supporting structure can vary widely depending on the design of a building.

Typically, a sheathing layer is installed on the roof supporting structure. The sheathing layer may comprise, for example, a wooden roof deck or metal sheeting. The roof cover elements 105 are laid over and across a sheathing layer 108 or, alternatively, directly on the roof supporting structure (if the sheathing layer is omitted). The non-vent roof cover elements 105 may comprise, for example, tiles (e.g., clay, metal, or concrete) or shingles (e.g., wooden, clay, asphalt, or composition). For example, the roof cover elements 105 may comprise steel. The illustrated roof cover elements 105 comprise tiles which are flat in shape. In other embodiments, the tiles may be M-shaped or S-shaped, as known in the art, though it is appreciated that other shapes of tiles may be utilized. Details of common M-shaped and S-shaped tiles are disclosed in U.S. Patent Application Publication No. US 2008/0098672 A1, the entirety of which is hereby incorporated by reference. A skilled artisan will appreciate that various other types of covering materials can be used for the roof cover elements 105.

In certain embodiments, the roof 100 may further include battens (not shown) extending parallel to and between the ridge 4 and the eave 5. The battens may be positioned on the sheathing layer 108 or, alternatively, directly on the roof supporting structure (if the sheathing layer is omitted), while supporting the roof cover elements 105. It will be appreciated that various configurations of battens can be adapted for the roof cover elements 105. In general, techniques for using battens to support tiles and other types of covering elements are well known.

The roof vent 110 includes one or more primary vent members 120 (alternatively referred to as "bases," "first vent members," or "subflashings") within openings 106 formed in the roof deck 108. The illustrated roof vent 110 includes two primary vent members 120 and one secondary vent member 130 (alternatively referred to as a "cover" or, if it resembles a roof tile, "vent tile") residing over the two primary vent members 120. In certain embodiments, the primary vent member(s) 120 and secondary vent member 130 may be integrated with each other, forming a single vent. Accordingly, features for mechanically fastening the primary vent member(s) 120 to the secondary vent member 130 can be provided. It will be appreciated that a plurality of roof vents 110 can be provided in one roof.

With reference to FIG. 2, the primary vent members 120 are installed at openings 106 in the roof deck 108. The primary vent members 120 may be secured to the roof deck 108 using any suitable securing means. Examples of the securing means include, but are not limited to: a bolt, a screw, a nail, a rivet, and an adhesive. However, an adhesive is preferred to seal around openings 106 to reduce the risk of water leakage through the roof 100.

The illustrated primary vent members 120 include apertures 121 penetrating their central portions. When the primary vent members 120 are installed, the apertures 121 are aligned with openings 106 and permit airflow between regions above and below the sheathing layer 108. The region below the sheathing layer 108 may include an attic or a living space of a building. The apertures 121 may be covered by screens 122 to prevent ingress of insects, vermin, leaves, and debris larger than the screen openings. The primary vent members 120 may also include upstanding baffles 123 that prevent ingress of water into the apertures 121.

In the illustrated embodiment, the secondary vent member 130 resides over the two primary vent members 120. However, the secondary vent member 130 could alternatively be off-set laterally, upslope, or downslope with respect to one or more primary vent members 120. The secondary vent member 130 preferably replaces one or more non-vent roof cover elements 105 of the layer of elements 105, by engaging surrounding elements 105 in accordance with a repeating engagement pattern of the elements 105. The secondary vent member 130 may be configured to mimic an appearance of the replaced one or more roof cover elements 105 so as to not detrimentally affect the appearance of the roof 100. The secondary vent member 130 may have substantially the same shape as that of the replaced one or more roof cover elements 105, for example, tiles or shingles. In certain embodiments, the secondary vent member 130 may slightly protrude above the level of the top surface of the layer of roof cover elements 105.

Figure 3:
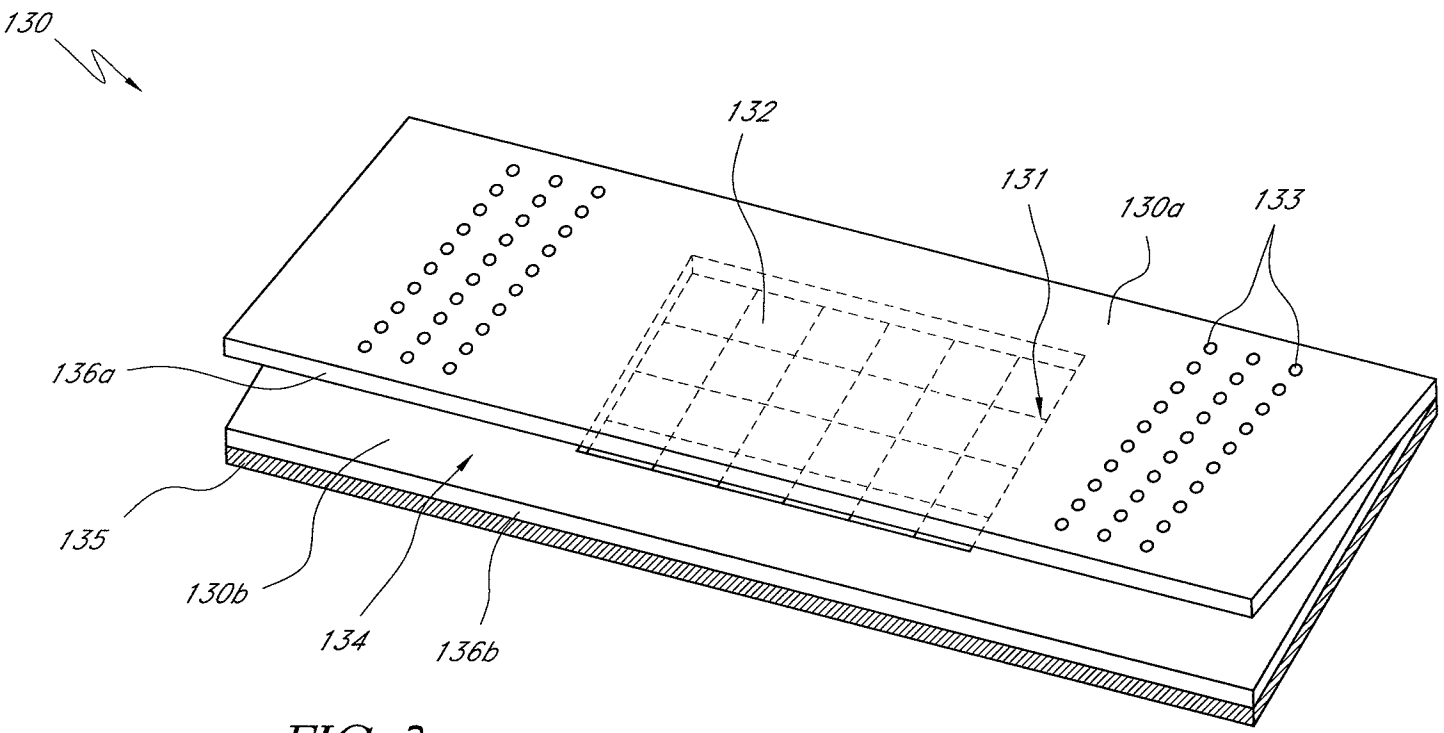
FIG. 3 is schematic perspective view of the secondary vent member in FIG. 2 having a radiant barrier underneath a bottom plate in one embodiment of the invention.

The secondary vent member 130, as illustrated in detail in FIG. 3, may include a top plate 130*a* and a bottom plate 130*b*. The top plate 130*a* may have holes 133 as illustrated. Alternatively, the top plate 130*a* may have louvers, as described in greater detail in U.S. Pat. No. 6,129,628 issued to Harry O'Hagin et al., the entirety of which is incorporated herein by reference. The bottom plate 130*b* may have one or more openings 131 covered with screens 132, and penetrating the central portion of the bottom plate 130*b*. In the illustrated embodiment, there is only one opening 131 and one screen 132. The opening 131 of the bottom plate 130*b* is in ventilating communication with the apertures 121 of the primary vent members 120, though the opening 131 need not be directly over or aligned with the apertures 121. Relative positions of the opening(s) in the secondary vent members 130 and the apertures 121 in the primary vent members 120 may differ widely, depending on the design or installation of the roof vent 110. For example, as illustrated in FIG. 2, the opening(s) in the secondary vent member 130 and the aperture 121 in the primary vent member 120 may be offset from each other.

The illustrated top plate 130*a* of the secondary vent member 130 comprises a round-shaped holes 133. However, it will be appreciated that the shape, position, and number of the holes can be varied. Air above the roof 100 may flow through the roof vent 110 by entering the holes 133 and through the opening 131, and then passing through the apertures 121 as well as through the openings 106. Air can pass through the roof vent 110 from below the roof 100 by reversing the flow path described above. Additionally, air can flow through a downslope gap 134 between 130*a* and 130*b*, without going through the holes 133.

In FIG. 3, the top plate 130*a* and the bottom plate 130*b* comprise downslope edges 136*a* and 136*b* spaced apart to define the gap 134 between the plates. The top plate 130*a* and the bottom plate 130*b* are connected to each other upslope of the opening 131. In the illustrated embodiment, the plates 130*a* and 130*b* are connected at their upslope edges. In some embodiments, the top plate 130*a* and the bottom plate 130*b* may have curved profiles rather than flat profiles, similar to the S-shaped and the M-shaped tiles described earlier.

In the illustrated embodiment, a radiant barrier layer 135 is provided underneath the bottom plate 130*b*. In other embodiments, a radiant barrier layer 135 may alternatively or additionally be underneath the top plate 130*a* (and above the bottom plate 130*b*) and/or even above the top plate 130*a*. Nevertheless, in some embodiments, the radiant barrier layer 135 is optional and may be omitted. The radiant barrier layer 135 includes a radiant barrier material that reflects radiant heat (e.g., solar radiation) away from the roof 100. Because openings 106 increase the extent to which radiation can pass through the roof 100, one application of the radiant barrier 135 is to counteract the overall reduction in the reflective capability of the roof 100 caused by the openings 106. The radiant barrier material may comprise a sheet or a coating. The coating may be formed of a paint blended with a radiant barrier additive, such as iron oxide. An exemplary radiant barrier material is highly reflective of solar radiation and includes, but is not limited to, aluminum. The radiant barrier layer 106 may further include a carrier layer, e.g., a substrate material on which the reflective material is supported, such as kraft paper, plastic films (e.g., polypropylene and polyethylene), or cardboard. In certain embodiments, the radiant barrier layer 135 is reinforced by fiber to increase the durability and ease of handling.

Another type of radiant barrier layer comprises a carrier layer with one or both sides having a material that is highly reflective of solar radiation, such as aluminum. The carrier layer may comprise one or more contiguous spacer layers or a plurality of separate spacer layer portions. The carrier layer preferably includes one or more air pockets, in order to reduce heat conduction through the carrier layer. Alternatively, the carrier layer comprises foam or other materials. In one embodiment, the radiant barrier layer comprises a bubble wrap carrier layer with one or both sides covered with a material reflective of solar radiation, such as aluminum foil. Preferably, the reflective material is spaced below the plate to which the radiant barrier is underneath and adjacent (e.g., 130*a*, 130*b*, and/or non-vent roof cover elements 105), to prevent direct heat conduction between the plate and the reflective material. The bubble wrap embodiment facilitates this when the reflective material is applied only to the bottom surface of the bubble wrap. A more detailed discussion of radiant barriers is found in U.S. Pat. No. 7,250,000 to William B. Daniels, II, the entirety of which is incorporated herein by reference.

Figure 4A:
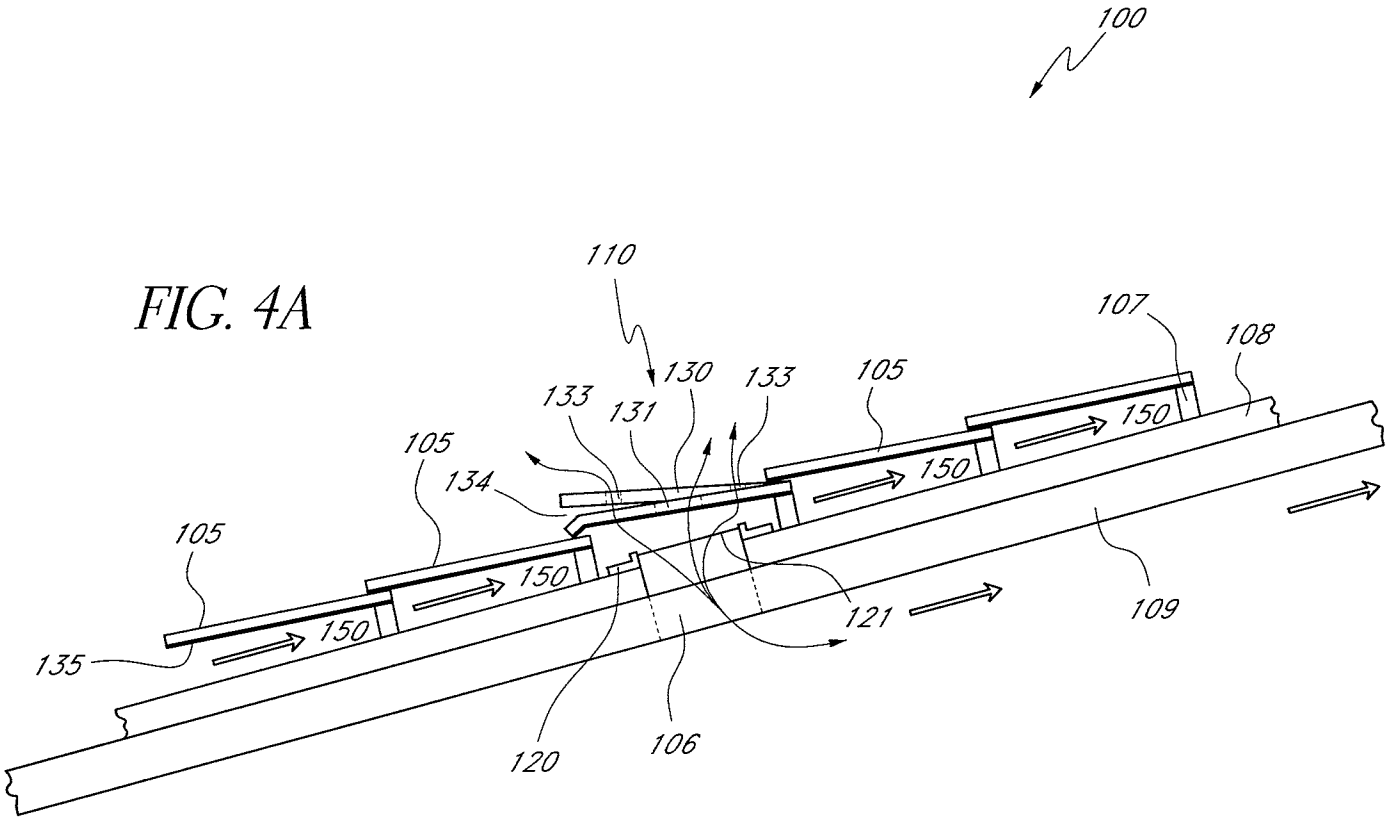
FIG. 4A is a cross-sectional view taken along line 4AB-4AB in FIG. 1A and shown with arrows indicating airflow according to one embodiment of the invention.

FIG. 4A illustrates a cross-sectional view of an embodiment of a roof structure with arrows indicating airflow. The roof 100 in FIG. 4A includes radiant barrier layers 135, battens 107, the non-vent roof cover elements 105 (illustrated as flat tiles for simplicity), the roof vent 110 (whose secondary vent member 130 replaces one of the non-vent roof cover elements 105), the roof supporting structure 109 (e.g., rafters), and the roof deck 108. Radiant barrier layers 135 are provided underneath both the non-vent roof cover elements 105 (or at least some of the them) and the secondary vent member 130. The battens 107 are spaced apart at a predetermined distance from one another and support the roof cover elements 105 and the radiant barrier layers 135. The roof vent 110 is provided between two neighboring battens 107.

Primary vent member 120 includes an aperture 121 as described earlier to permit airflow between the region below the roof deck 108 and a gap region 150 (described below) via opening 106. Additionally, secondary vent member 130 includes an opening 131, holes 133 (indicated schematically by dotted lines), and a downslope gap 134 to permit airflow between the region above the roof 100 and the gap region 150. Gap region 150 (also referred to as an "air layer" or a "batten cavity") is defined between the roof cover elements 105 and the roof deck 108. Typically, the thickness of the gap region 150 is defined by the size of the battens 107. Battens 107 are spaced apart through the gap region 150 and may comprise openings (not shown) to permit airflow therethrough between the batten's ridge-facing side and the eave-facing side. Battens with such openings are often referred to as "flow-through battens." The flow-through battens 107 may be screened or otherwise filtered to prevent the passage of insects, vermin, leaves, debris, and the like through such openings of the battens 107. A skilled artisan will understand that the airflow through the gap region 150 advantageously provides additional improvements in energy efficiency. In some embodiments, air can flow from gap region 150 to the region above the roof 100 by flowing through gaps between the roof cover elements 105. This is described in U.S. Pat. No. 6,491,579, the entirety of which is herein incorporated by reference.

With continued reference to FIG. 4A, in the preferred embodiment, a radiant barrier layer 135 is preferably provided underneath some or all of the non-vent roof cover elements 105. The radiant barrier layers 135 are preferably positioned between the gap region 150 and both the non-vent roof cover elements 105 and the secondary vent member 130 so that radiant heat is reflected upward before reaching the gap region 150. The radiant barrier layer 135 preferably comprises one or more openings (not shown) aligned with the opening 131 to further allow for airflow therethrough.

Figure 4B:
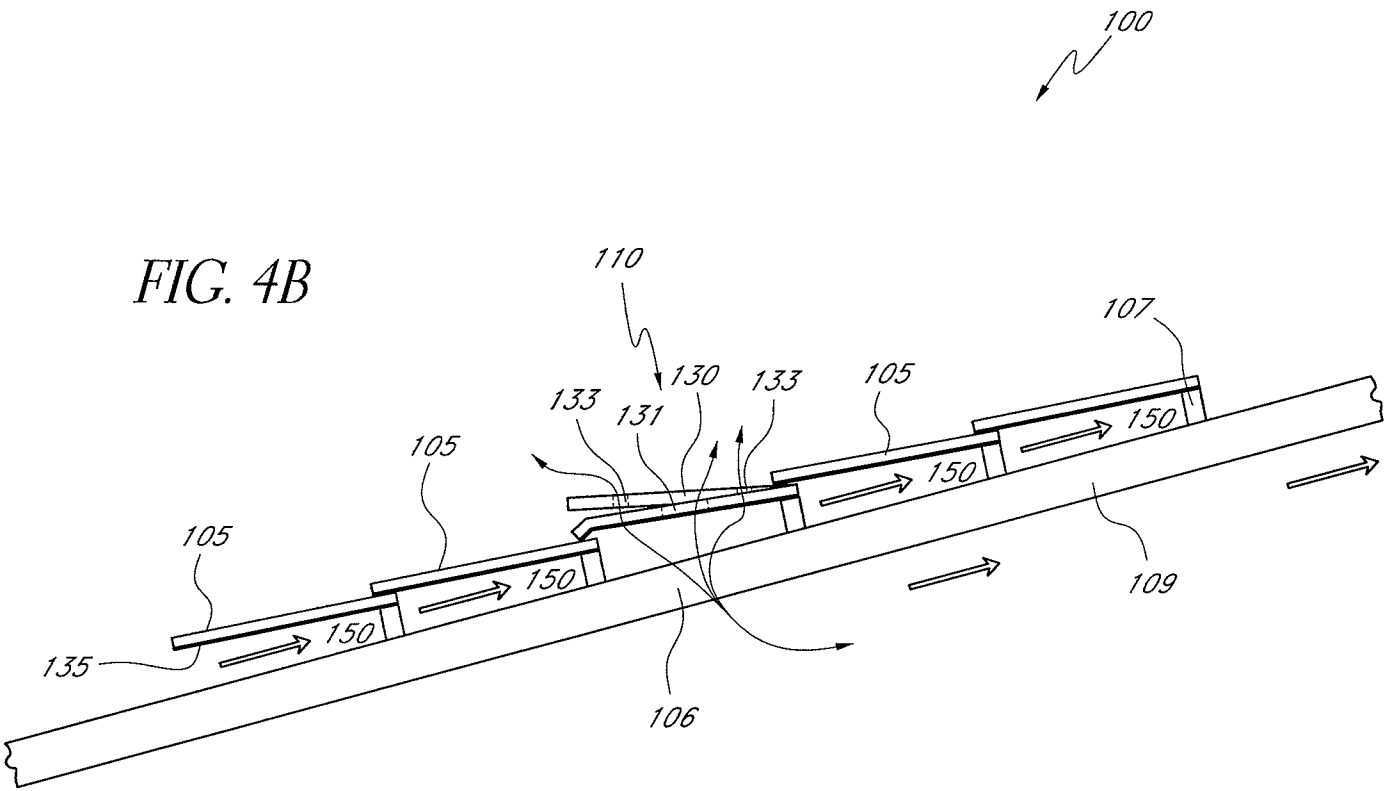
FIG. 4B is a cross-sectional view taken along line 4AB-4AB in FIG. 1A and shown with arrows indicating airflow according to another embodiment of the invention.

In still other embodiments, FIG. 4B illustrates the secondary vent member 130 used in the roof 100 without a sheathing layer or a roof deck 108. In this embodiment, the battens 107 are supported by the rafters 109 without a sheathing layer interposed therebetween, and the primary vent members are omitted. Radiant barrier layers 135 can still be provided with the non-vent roof cover elements 105 and the secondary vent members 130. For example, the radiant barrier layers 135 can be positioned below the top surfaces of the non-vent roof cover elements 105 and the secondary vent members 130.

Figure 5A:
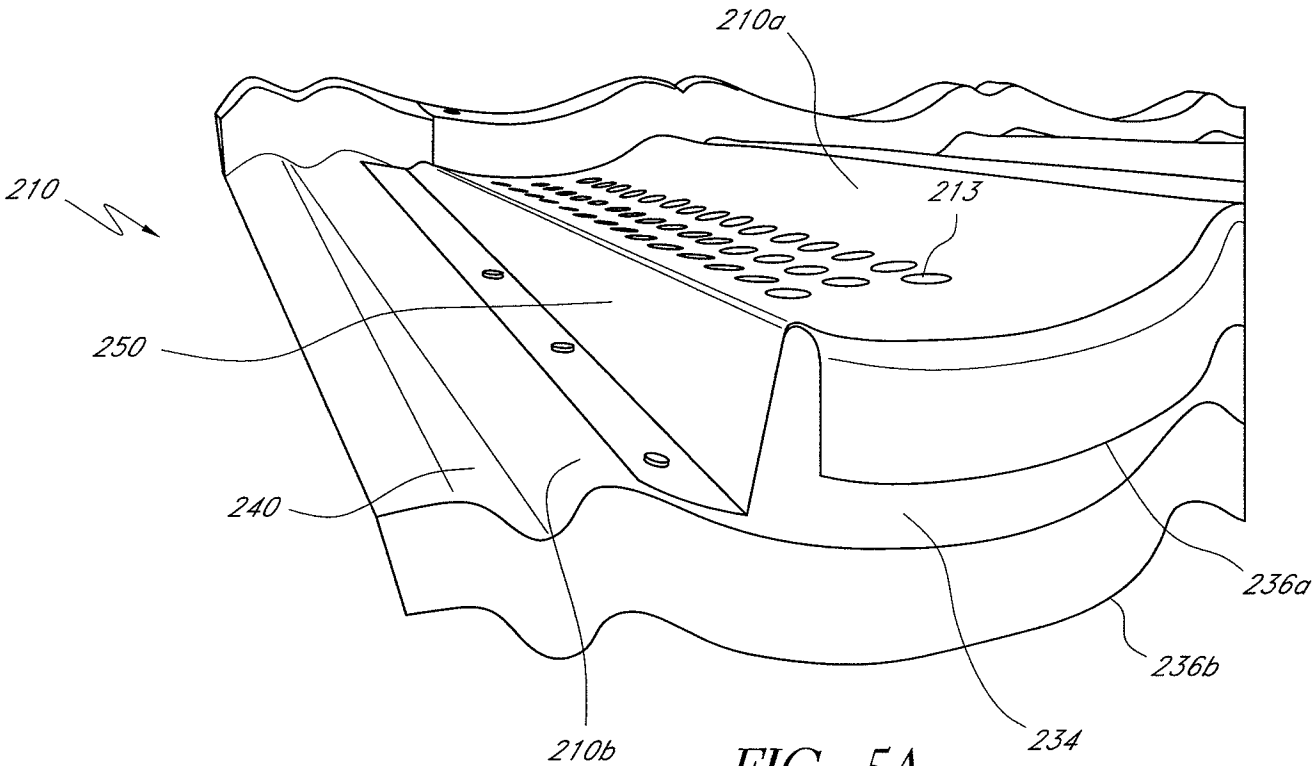
FIG. 5A is a schematic perspective view of a secondary vent member having a lateral interlocking profile according to another embodiment of the invention.
Figure 5B:
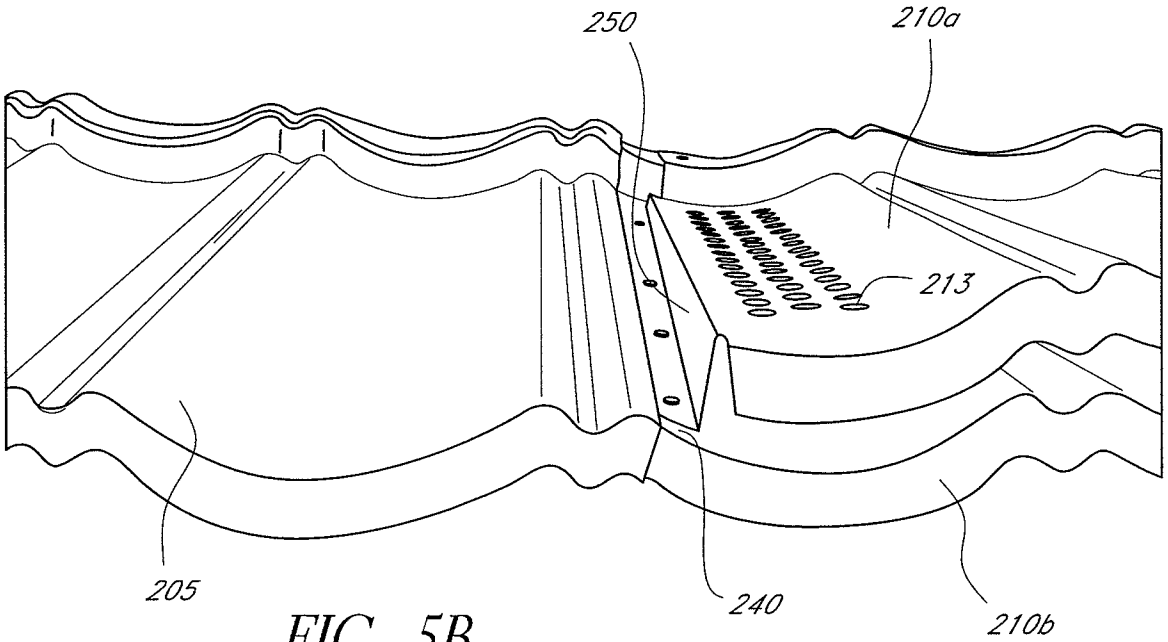
FIG. 5B is a schematic perspective view of a secondary vent member having the lateral interlocking profile in FIG. 5A engaged with a roof tile.

FIG. 5A illustrates another embodiment of a secondary vent member 210. The secondary vent member 210 has an engagement structure 240 configured to engage with a compatible, preferably similarly shaped engagement structure of a neighboring roof cover element 205, as illustrated in FIG. 5B. Although not shown, the secondary vent member 210 preferably has a substantially similar or identical engagement structure 240 on its opposite end. Preferably, the engagement structure 240 is similar or identical to a repeating engagement structure of the non-vent roof cover elements 205, by which the elements 205 engage each other. Thus, a plurality of roof cover elements 205 and secondary vent members 210 may engage with one another to collectively form a repeating engagement pattern when assembled on a roof. The secondary vent member 210 may mimic the appearance of one or more of the non-vent roof cover elements 205. Additionally, radiant barrier layers may be on or within the bodies of roof cover elements 205 (including members 210), and preferably positioned underneath the top surfaces of the roof cover elements 205. Radiant barrier layers may also be provided on the secondary vent members 210, such as under plate 210*b*, under plate 210*a* but above plate 210*b*, and/or above plate 210*a*.

In FIG. 5A, the secondary vent member 210 comprises a top plate 210*a* and a bottom plate 210*b*. The top plate 210*a* comprises holes 213 and the bottom plate 210*b* comprises an opening (not shown but which can be similar to the opening 131 of FIG. 3). This opening can be covered by a screen (not shown but which can be similar to the screen 132 of FIG. 3).

The top plate 210*a* and the bottom plate 210*b* comprise downslope edges 236*a* and 236*b* spaced apart to define a gap 234 between the plates. In the illustrated embodiment, each plate 210*a* and 210*b* has a downwardly extending flange at its downslope end, the downslope edges 236*a* and 236*b* comprising the lower edges of the flanges. The top plate 210*a* and the bottom plate 210*b* are connected to each other upslope of the opening in bottom plate 210*b*, for example at or near the upslope edges of the plates 210*a* and 210*b*. Each of the top and bottom plate 210*a*, 210*b* can be formed of a single continuous piece of material (e.g., metal). In some applications, the top plate 210*a* may be treated so as to more closely resemble surrounding non-vent roof cover elements 205, such as being powder coated with a stone coat surface. In other applications, the top plate 210*a* can comprise steel with a stone coating that is highly reflective of ultraviolet radiation.

In one embodiment, the engagement structures 240 comprise lateral end portions of the bottom plate 210*b*, which extend laterally beyond the lateral edges of the top plate 210*a*. The lateral end portions of engagement structure 240 have non-planar profiles (e.g., grooves, slots, channels) that conform to and engage a similar or identical profile of an adjacent non-vent roof cover element 205 or another secondary vent member 210. In FIG. 5B, the roof cover element 205 (e.g., tile) completely engages with the lateral end portion of engagement structure 240 of the secondary vent member 210. The secondary vent member 210 further comprises a sidewall 250 connecting the top plate 210*a* with the bottom plate 210*b* along the lateral edge of the top plate 210*a*. In some embodiments, the sidewall 250 is fastened to the bottom plate 210*b* using a bolt, screw, nail, rivet, or adhesive. The sidewall 250 is configured to prevent the ingress of water, insects, leaves, debris, and vermin into the gap between the top plate 210*a* and the bottom plate 210*b*. The height of the sidewall 250 is preferably larger than the downwardly extending flange at downslope edge 236*a*.

Referring to FIGS. 6A-6D, additional embodiments of secondary vent members 310 of a roof vent will be described below. Each illustrated secondary vent member 310 can be similar or substantially identical in structure and functionality to the secondary vent member 210 described above and illustrated in FIGS. 5A and 5B, with the only difference being that the secondary vent member 310 mimics the profile and appearance of a different style or design of roof cover element. Each illustrated secondary vent member 310 includes a top plate 310*a* and a bottom plate 310*b*. Embodiments can also mate with and/or mimic an appearance of surrounding roof cover elements (e.g., tiles), and can prevent the ingress of undesirable elements such as leaves, debris, wind-driven rain, and vermin. Additionally, radiant barrer layers (as described in connection with FIG. 3) can be provided under plates 310*b*, under plate 310*a* but above plate 310*b*, and/or above plate 310*a*.

Figure 6A:
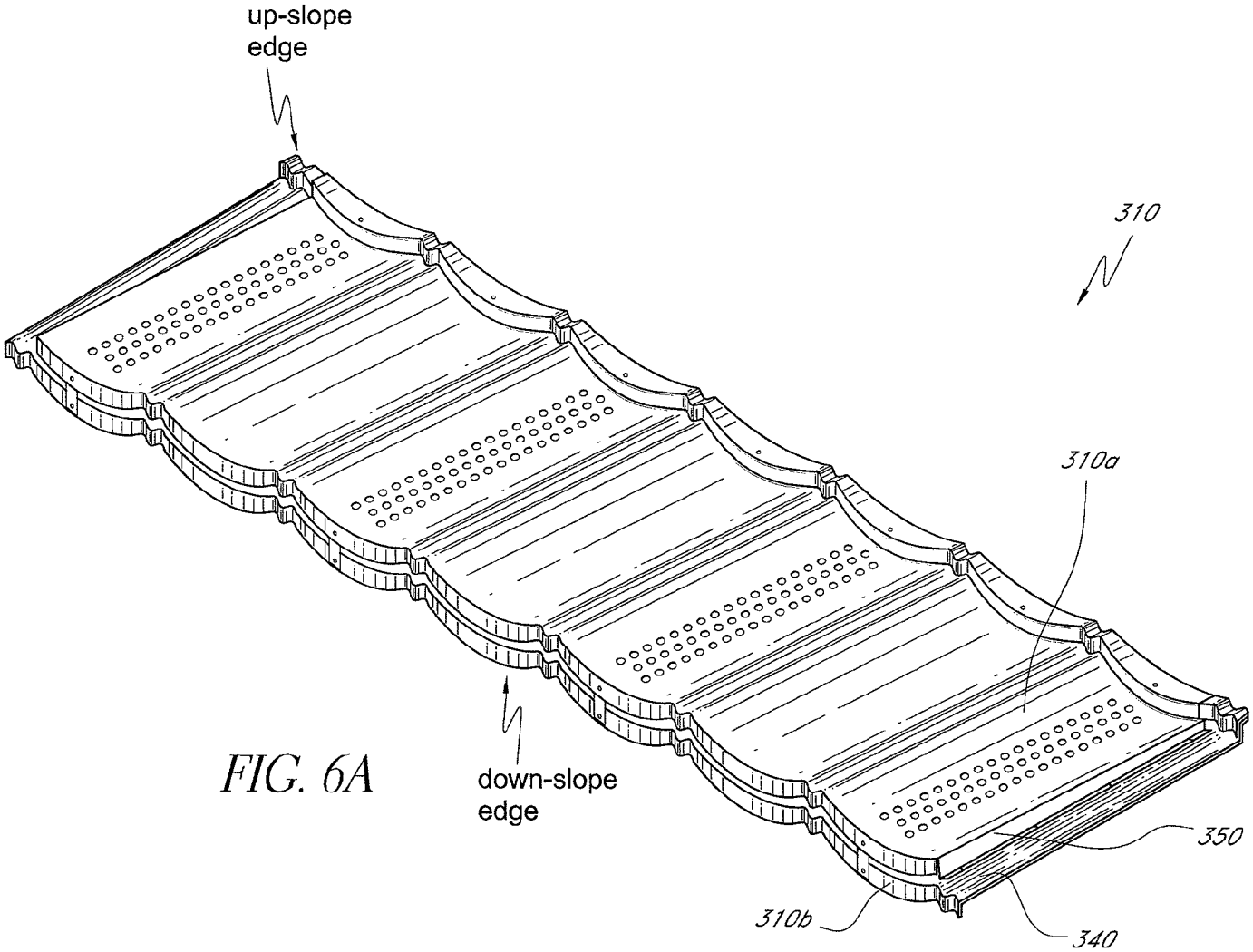
FIG. 6A is a schematic perspective view of a secondary vent member according to another embodiment of the invention.
Figure 6B:
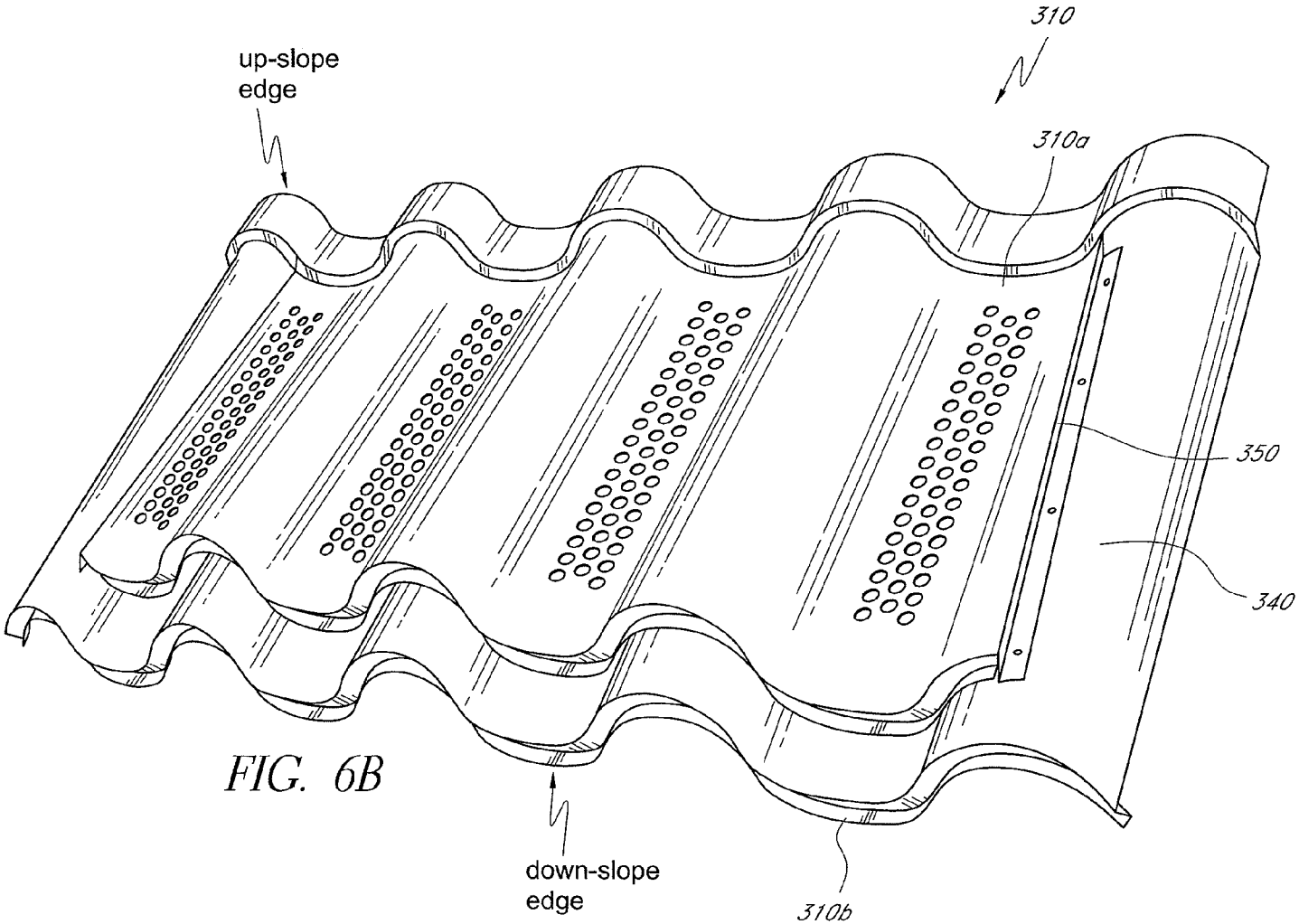
FIG. 6B is a schematic perspective view of a secondary vent member design according to another embodiment of the invention.
Figure 6C:
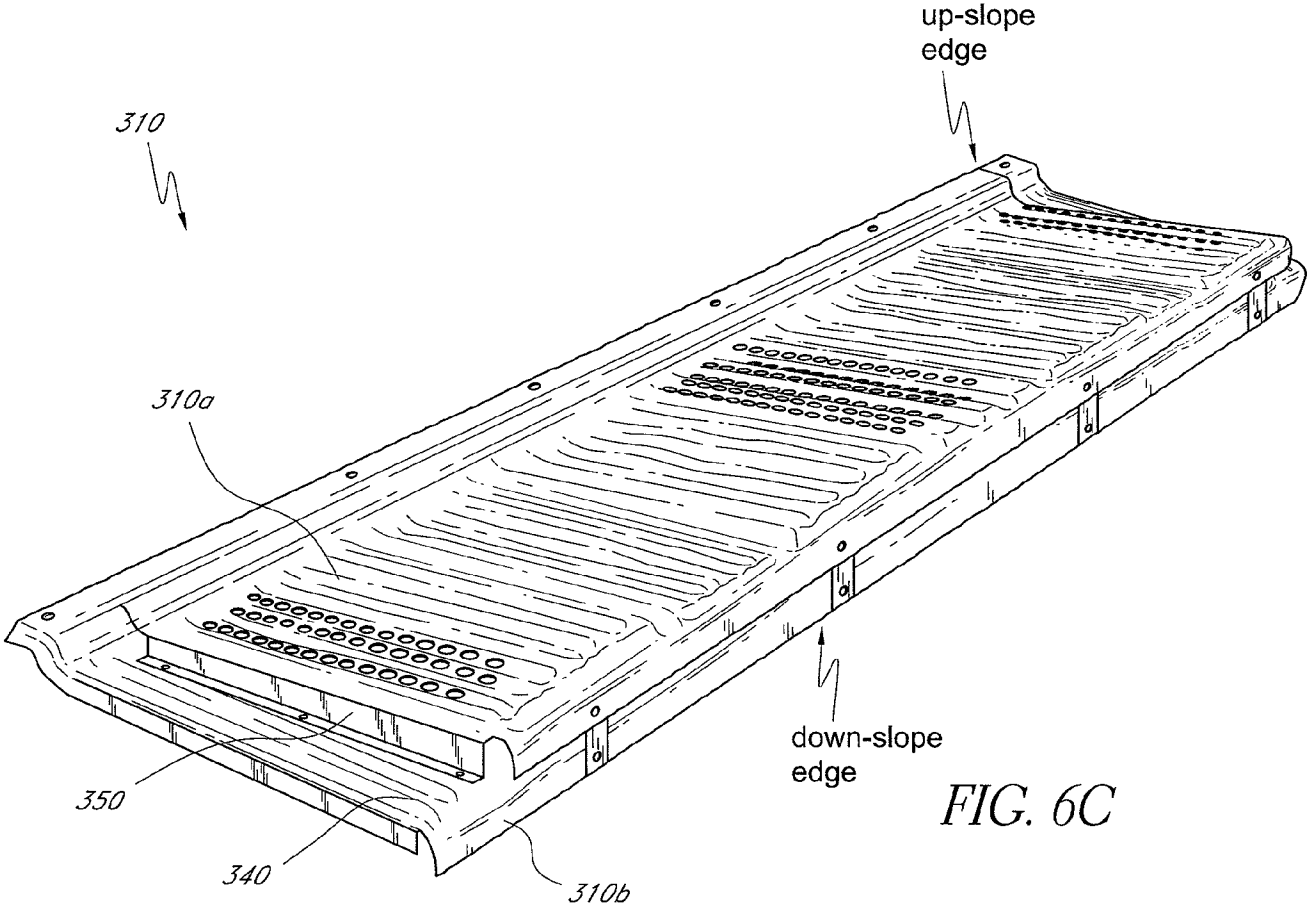
FIG. 6C is a schematic perspective view of a secondary vent member design according to another embodiment of the invention.
Figure 6D:
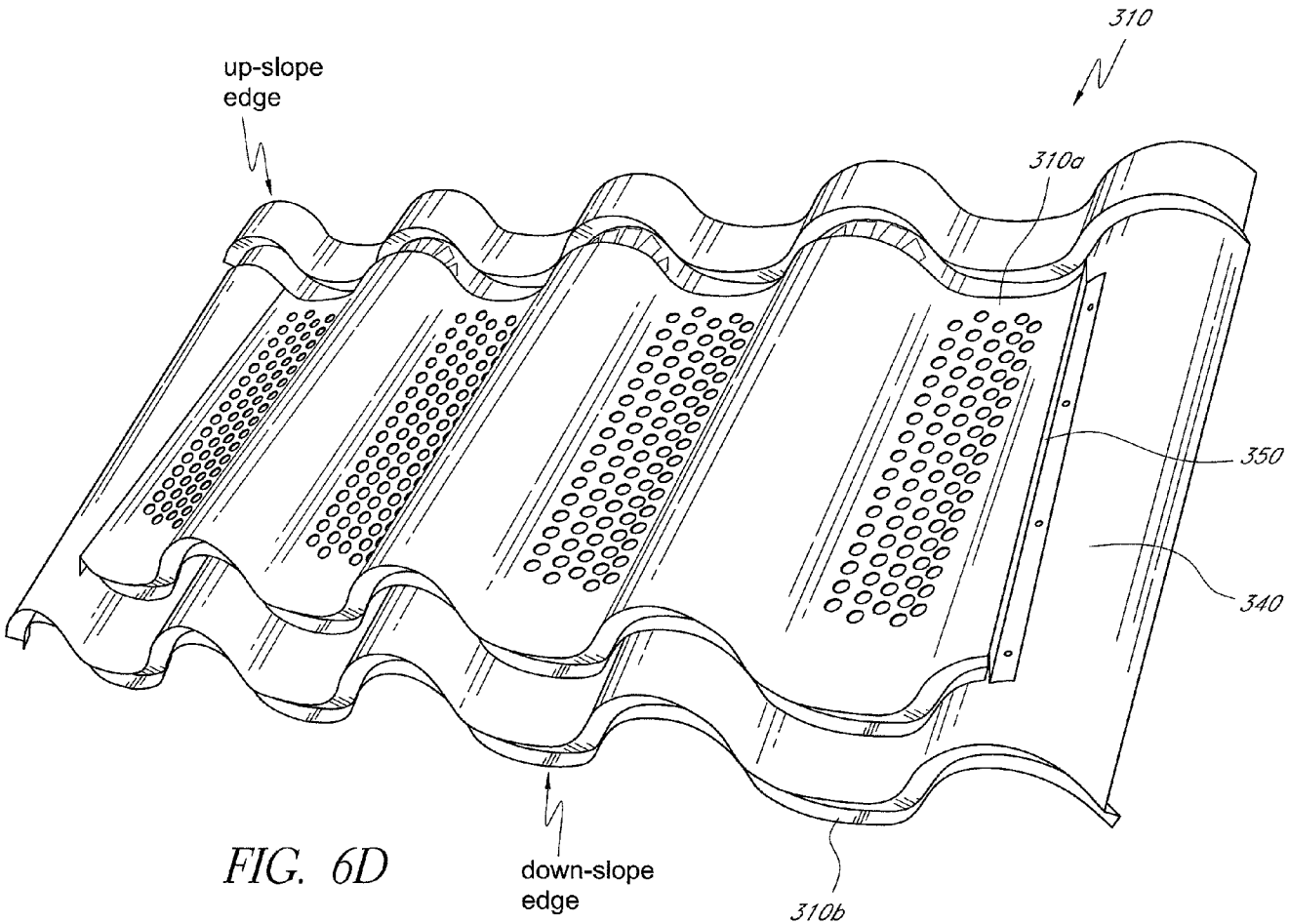
FIG. 6D is a schematic perspective view of a secondary vent member design according to another embodiment of the invention.

FIGS. 6A-6D provide four different embodiments of secondary vent members 310 having different designs. In some embodiments, the top plate 310*a* and the bottom plate 310*b* are substantially parallel to each other but separated by an air gap. FIGS. 6B and 6D show downslope edges of the top plate 310*a* being recessed from the downslope edge of the bottom plate 310*b*. However, the downslope edge of the top plate 310*a* can be closer to the downslope edge of the bottom plate 310*b*, even aligned therewith. The top and bottom plates 310*a*, 310*b* can be shaped to have a profile that mimics the appearance of surrounding roof cover elements. As discussed earlier in FIGS. 5A-5B, the bottom plate 310*b* can further comprise engagement structures 340 in the form of lateral end portions having non-planar profiles configured to mate with similar profiles of an adjacent roof cover element. Additionally, the secondary vent member 310 can include sidewalls 350 connecting the lateral edges of the top plate 310*a* with the bottom plate 310*b*.

Figure 7:
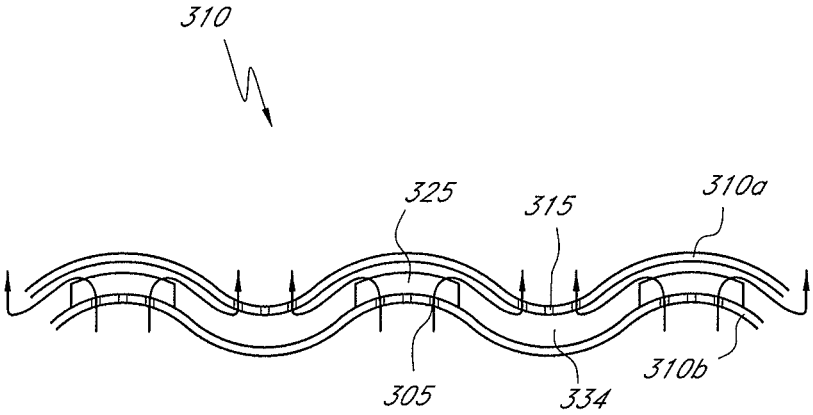
FIG. 7 is a schematic front view of a secondary vent member having a baffle according to one embodiment of the invention.

FIG. 7 is a side view of one embodiment of the secondary vent member of the roof vent of FIG. 6D viewed from the downslope edge of FIG. 6D, illustrating an embodiment of a baffle structure for preventing ingress of rain and debris through the secondary vent member. The baffle embodiments described below may also be adapted for the secondary vent members of FIGS. 3, 5A-5B, and 6A-6C, and any other embodiments of secondary vent members that have configurations that are compatible with the illustrated baffle structures. The illustrated secondary vent member 310 includes a top plate 310*a* and a bottom plate 310*b*, forming a gap 334 in between at the downslope edges, while the upslope edges of the top and bottom plates 310*a* and 310*b* can be attached to each other, leaving no space in between them. This configuration blocks the upslope edge of the secondary vent member 310, preventing ingress of water into the opening(s) of the bottom plate 310*b*. The top plate 310*a* has a plurality of holes 315 that allow fluid communication between the gap 334 and a region above the secondary vent member 310. The bottom plate 310*b* has one or more openings 305 that allow fluid communication between the gap 334 and a region below the secondary vent member 310.

Figure 8:
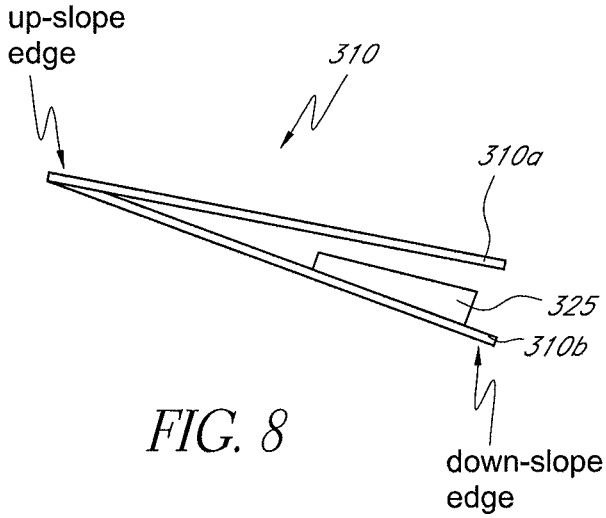
FIG. 8 is a schematic side view of a secondary vent member having a baffle according to another embodiment of the invention.

The illustrated secondary vent member 310 also includes one or more baffles 325 preferably connected to the bottom plate 310*b* and configured to prevent ingress of water (e.g., wind-driven rain) into the openings 305 of the bottom plate 310*b*. As shown in FIG. 8, the baffle 325 is positioned near the downslope edge of the secondary vent member 310, forming walls partially surrounding the opening 305 of the secondary vent member 310. In the illustrated embodiment in FIG. 9, the baffle 325 extends (1) between the opening 305 and the downslope edge of the bottom plate 310*b*, (2) between the opening 305 and the right lateral edge of the bottom plate 310*b*, and (3) between the opening 305 and the left lateral edge of the bottom plate 310*b*. This configuration helps to prevent the ingress of wind-driven rain into the opening 305 of the secondary vent member 310.

Figure 9:
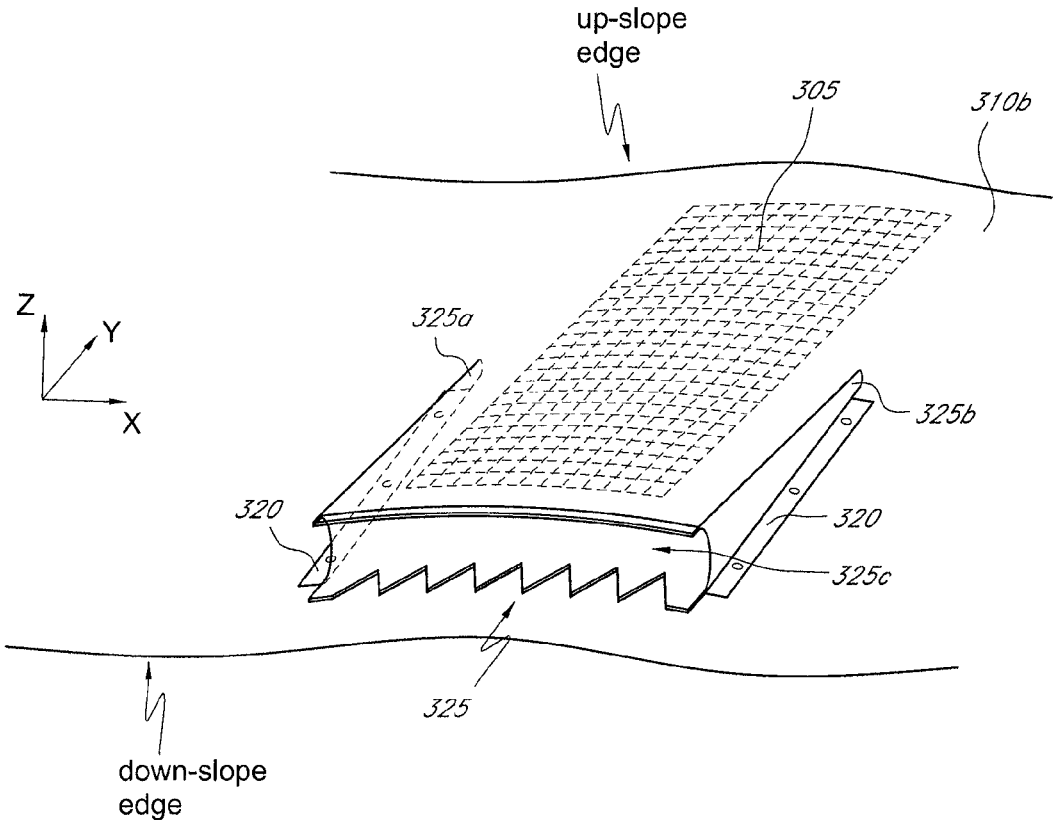
FIG. 9 is a perspective view of a bottom plate with an opening, including a baffle, in accordance with another embodiment of the invention.

Referring to FIG. 9, one embodiment of a baffle 325 for a secondary vent member 310 will be described in detail. The illustrated baffle 325 includes a first sidewall 325*a*, a second sidewall 325*b*, and a third sidewall 325*c*. The first to third sidewalls 325*a*-325*c* are secured to the top surface of the bottom plate 310*b* of the secondary vent member 310, using any suitable connecting means. The first and second sidewalls 325*a*, 325*b* extend substantially in a direction that is generally transverse to the direction of the eave of a roof when the secondary vent member 310 is installed in the roof. The third sidewall 325*c* extends in a direction that is generally parallel to the direction of the eave of a roof when the secondary vent member 310 is installed in the roof. In other embodiments, the directions of the sidewalls can vary widely, depending on the configuration of the secondary vent member. For example, the sidewalls need not extend linearly, but may be curved.

One end of the first sidewall 325*a* closest to the downslope edge is preferably attached to one end of the third sidewall 325*c*. One end of the second sidewall 325*b* closest to the down-slope edge is preferably attached to the other end of the third sidewall 325*c*. For example, the first, second, and third sidewalls 325*a*, 325*b*, 325*c* can be joined together, the first and second sidewall 325*a*, 325*b* positioned on opposite sides of the opening 305 and oriented generally transverse to the downslope edge of the bottom plate 310*b*. The third sidewall 325*c* is positioned downslope of the opening 305 and oriented generally parallel to the downslope edge of the bottom plate 310*b*. In some embodiments, the sidewalls need not connect end-to-end with other sidewalls, but may connect at other points along a given sidewall. The sidewalls may be formed integrally with one another or formed separately.

Figure 10A:
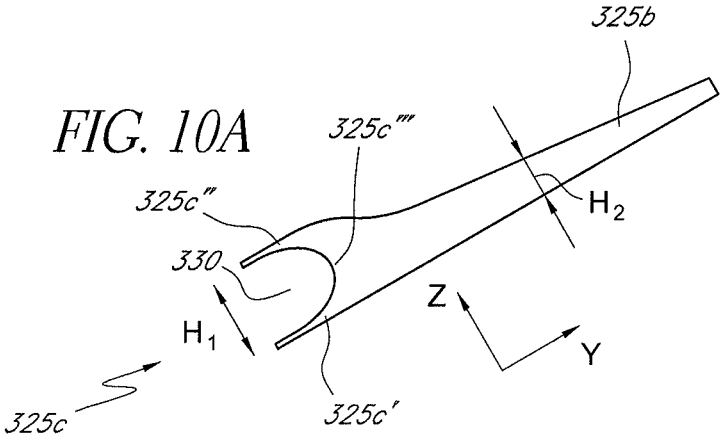
FIG. 10A is a side view of a baffle according to another embodiment of the invention.
Figure 10B:
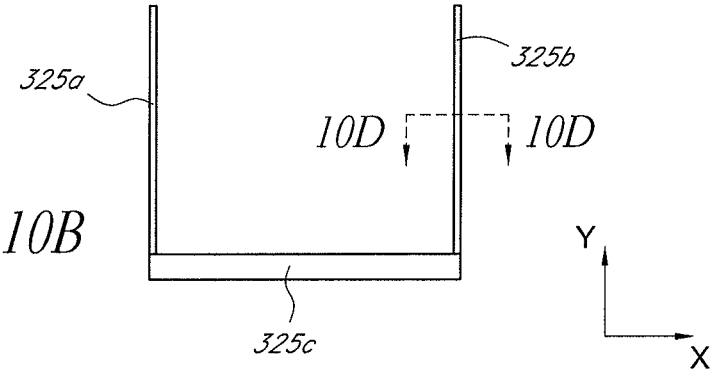
FIG. 10B is a top plan view of the baffle of FIG. 10A.
Figure 10C:
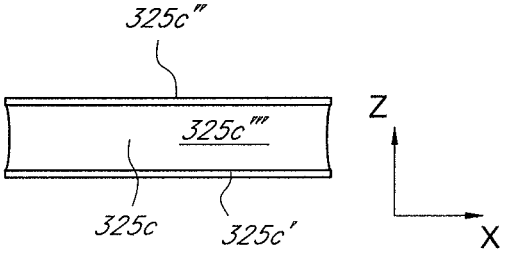
FIG. 10C is a front view of the baffle of FIG. 10A.
Figure 10D:
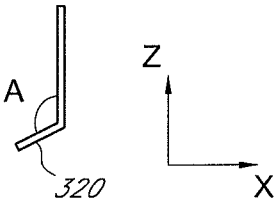
FIG. 10D is a cross-sectional view of the baffle of FIG. 10B, taken along the line 10D-10D.

Each of the first and second sidewalls 325*a*, 325*b* may have an L-shaped cross-section when viewed from the downslope edge, as shown in FIG. 10D. An angle A formed by the cross-section may or may not be 90 degrees, and may vary widely, depending on the curvature of the top surface of the bottom plate 310*b* of the secondary vent member 310. A portion 320 of the L-shape can be secured to the bottom plate 310*b* by, e.g., rivets, screws, nuts and bolts, adhesive, and the like.

Figure 11A:
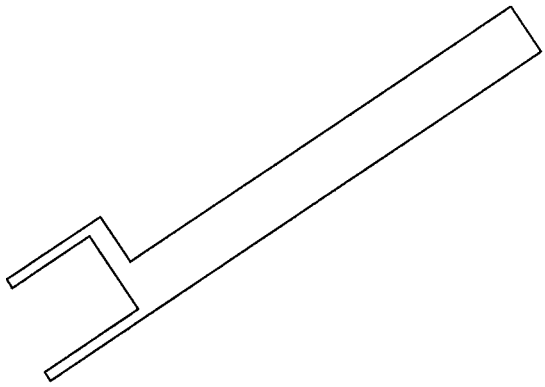
FIGS. 11A-11C are schematic side views of baffles, according to other embodiments.
Figure 11B:
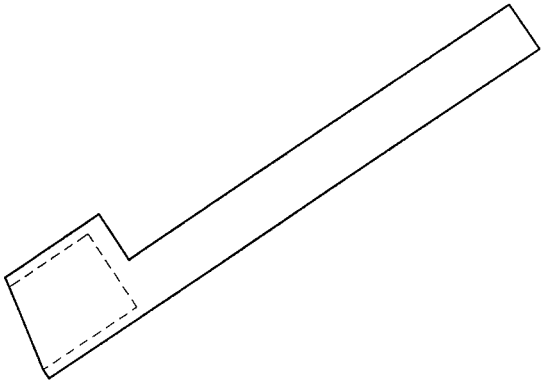
Figure 11C:
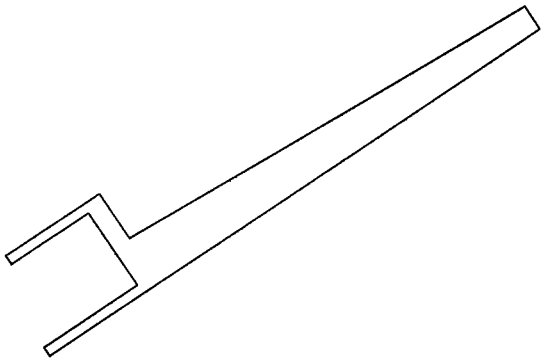

The third sidewall 325*c* may have a U-shaped cross section, for example, as shown in FIG. 10A. The illustrated third sidewall 325*c* includes a first portion 325*c*' secured to the top surface of the bottom plate 310*b* of the secondary vent member 310, a second portion 325*c*" spaced from the first portion 325*c*', and a third portion 325*c*'" that connects the second portion 325*c*" to the first portion 325*c*'. In some embodiments, portion 325*c*' can be omitted. The third portion 325*c*'" extends upward from the bottom plate 310*b*, and the second portion 325*c*" extends from the third portion 325*c*'" in a downslope direction away from the opening 305, to define a space 330 between the bottom plate 310*b* and the second portion 325*c*". In other embodiments, the cross-section and ends of the third sidewall 325*c* may have different shapes, for example, as shown in FIGS. 11A-11C.

The U-shaped cross section of the third sidewall 325*c* prevents ingress of water into the opening 305 of the bottom plate 310*b* of the secondary vent member 310. In addition, the U-shaped cross section facilitates air circulation and generates an area of low pressure. This configuration helps draw air out of a region below the secondary vent member 310 (for example, an attic region under the roof).

The third sidewall 325*c* has a first height H1 that effectively blocks ingress of water into the opening 305 of the bottom plate 310*b*. The first and second sidewalls 325*a*, 325*b* may have a second height H2 that is smaller than the first height H1. This configuration facilitates lateral air flow in the gap between the top and bottom plates 310*a*, 310*b* of the secondary vent member 310 (because more air can flow between the top edges of the baffle walls 325*a*, 325*b* and the bottom side of the top plate 310*a*) while preventing ingress of water into the opening 305 of the bottom plate 310*b*. This is also true of the embodiment shown in FIG. 11C. The illustrated first and second sidewalls 325*a*, 325*b* have a height that increases toward the third sidewall 325*c*. In other embodiments, the first and second sidewalls 325*a*, 325*b* may have a uniform height, as shown in FIGS. 11A and 11B. In some embodiments, the first and second sidewalls 325*a*, 325*b* of the baffle 325 may block the ends of the third sidewall 325*c*, as shown in FIG. 11B.

Referring back to FIG. 9, an embodiment of a baffle 325 that is suitable for a curved bottom plate 310*b* of a secondary vent member 310 will be described below. The illustrated baffle 325 includes first to third portions 325*c*'-325*c*'". The first portion 325*c*' includes a zigzagged edge extending in a direction generally parallel to the direction of the eave of a roof when a secondary vent member 310 is installed in the roof. The zigzagged edge includes a plurality of V-shaped recesses. In addition, the baffle 325 may be formed of a flexible material, for example, a polymer or a flexible metal (e.g., aluminum). This configuration allows the baffle 325 to be secured to the top surface of a curved bottom plate 310*b* of a secondary vent member 310 (i.e., curved about an axis generally transverse to the eave). The shape of the zigzagged edge may vary widely.

In addition, the baffle 325 may be attached to the top surface of the bottom plate 310*b* using a water-proof seal. This configuration helps to prevent ingress of water underneath the baffle 325 into the opening 305 of the bottom plate 310*b*.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications thereof. Thus, it is intended that the scope of the present invention herein disclosed should not be limited by the particular disclosed embodiments described above, but should be determined only by a fair reading of the claims that follow.

What is claimed is:

1. A roof vent comprising:

a roof cover layer vent member comprising a bottom plate and a top plate having downslope edges spaced apart to define an open downslope end with a gap between the plates, wherein the bottom plate comprises an opening to allow airflow between the gap and a space below the bottom plate, and wherein the bottom plate and the top plate are connected to each other upslope of the opening; and a baffle connected to the bottom plate and positioned between the bottom plate and the top plate, wherein at least a portion of the baffle is positioned between the downslope edge and the opening, said portion of the baffle comprising a cross-section having a first portion extending upward from the bottom plate and a second portion extending from the first portion in a downslope direction away from the opening, to define a space between the bottom plate and the second portion.

2. The roof vent of claim 1, further comprising a sheathing layer vent member having an aperture through which air from an attic may be ventilated, the sheathing layer vent member configured to be installed at an opening in a sheathing layer of a roof, with the aperture aligned with the opening.

3. The roof vent of claim 1, wherein the baffle comprises first, second, and third sidewalls joined together, the first and second sidewalls positioned on opposite sides of the opening and oriented generally transverse to the downslope edge of the bottom plate, and the third sidewall positioned downslope of the opening and oriented generally parallel to the downslope edge of the bottom plate.

4. The roof vent of claim 3, wherein the third sidewall comprises a U-shaped cross-section.

5. The roof vent of claim 3, wherein the first and second sidewalls comprise an L-shaped cross-section.

6. A roof structure comprising:

a roof deck having a plurality of openings;

a plurality of primary vent members installed on the roof deck, each primary vent member having an aperture positioned in alignment with one of the openings in the roof deck so that the apertures permit airflow between regions above the roof deck and below the roof deck; and a roof cover layer spaced above the roof deck to define an air layer therebetween, the roof cover layer comprising:

a plurality of non-vent roof cover elements, and a plurality of secondary vent members each having at least one opening to permit airflow from the air layer to a space above the roof cover layer, wherein the aperture of each primary vent member and the at least one opening of each of the secondary vent members are offset with respect to each other;

wherein a total number of primary vent members in the roof structure is at least 1.5 times a total number of secondary vent members in the roof structure.

7. The roof structure of claim 6, wherein each secondary vent member mimics an appearance of one or more of the non-vent roof cover elements.

8. The roof structure of claim 6, wherein each secondary vent member comprises a bottom plate and a top plate spaced apart to define a gap therebetween, the at least one opening of the secondary vent member being formed within the bottom plate.

9. A roof structure comprising:

a layer of roof tiles that form a repeating pattern when assembled on a roof; and at least one vent member that replaces and mimics an appearance of one or more of the roof tiles within said layer;

wherein the vent member comprises a cover member and a base member joined together and having downslope edges spaced apart, the base member having lateral end portions extending laterally beyond lateral edges of the cover member, each of the lateral end portions of the base member having a non-planar profile conforming to and engaging a similar profile of an horizontally adjacent roof tile.

10. The roof structure of claim 9, wherein the vent member includes vertical walls extending from the base member to the lateral edges of the cover member to substantially prevent the ingress of water between the lateral edges of the cover member and the base member.

* * * * *